US009739582B2

(12) United States Patent
Billings

(10) Patent No.: US 9,739,582 B2
(45) Date of Patent: Aug. 22, 2017

(54) SHOTGUN SHELL

(71) Applicant: VISTA OUTDOOR OPERATIONS LLC, Clearfield, UT (US)

(72) Inventor: Chris L. Billings, Layton, UT (US)

(73) Assignee: VISTA OUTDOOR OPERATIONS LLC, Farmington, UT (US)

( * ) Notice: Subject to any disclaimer, the term of this patent is extended or adjusted under 35 U.S.C. 154(b) by 0 days.

(21) Appl. No.: 14/823,769

(22) Filed: Aug. 11, 2015

(65) Prior Publication Data

US 2015/0345918 A1 Dec. 3, 2015

Related U.S. Application Data

(63) Continuation of application No. 13/683,795, filed on Nov. 21, 2012, now abandoned.

(60) Provisional application No. 61/562,361, filed on Nov. 21, 2011.

(51) Int. Cl.

| | |
|---|---|
| ***F42B 7/08*** | (2006.01) |
| ***F42B 7/04*** | (2006.01) |
| ***F42B 10/50*** | (2006.01) |

(52) U.S. Cl.

CPC ..... *F42B 7/08* (2013.01); *F42B 7/04* (2013.01); *F42B 10/50* (2013.01)

(58) Field of Classification Search

CPC ..... F42B 7/00; F42B 7/02; F42B 7/04; F42B 7/08; F42B 7/10

USPC ..... 102/448, 449, 450, 451, 453, 461, 532, 102/457

See application file for complete search history.

(56) References Cited

U.S. PATENT DOCUMENTS

| | | | | |
|---|---|---|---|---|
| 3,516,360 | A | 6/1970 | Lathrope et al. | |
| 3,721,197 | A | 3/1973 | Hughes et al. | |
| 4,553,481 | A | 11/1985 | Ricci | |
| 4,627,356 | A | 12/1986 | Buczkowski | |
| 4,773,329 | A | 9/1988 | Bilsbury | |
| 5,325,765 | A | 7/1994 | Sylvan et al. | |
| 5,361,701 | A | 11/1994 | Stevens | |
| 5,471,931 | A * | 12/1995 | Gardner | F42B 7/08 102/449 |
| 5,472,719 | A | 12/1995 | Favre | |
| 6,258,316 | B1 * | 7/2001 | Buenemann, Jr. | B22F 1/0014 102/449 |
| 6,260,484 | B1 | 7/2001 | Billings | |
| 6,367,388 | B1 | 4/2002 | Billings | |
| 6,539,873 | B2 | 4/2003 | Diller | |
| 7,174,833 | B2 * | 2/2007 | Diller | F42B 7/08 102/449 |
| 7,243,603 | B2 | 7/2007 | Sheaffer | |
| 7,523,581 | B1 | 4/2009 | Leutenegger et al. | |
| 7,926,424 | B1 | 4/2011 | Quintana et al. | |
| 8,220,393 | B2 | 7/2012 | Schluckebier et al. | |
| 8,555,785 | B2 | 10/2013 | Cross | |

(Continued)

*Primary Examiner* — James S Bergin
(74) *Attorney, Agent, or Firm* — Christensen, Fonder, Dardi & Herbert PLLC

(57) ABSTRACT

A shotgun cartridge having a weighted wad for controlling the separation point between the wad and the shot load. The wad having a tail portion and a nose portion with the nose portion shifting the center of gravity of the wad axially forward away from the center of pressure compared to where the center of gravity would be if the nose portion was not weighted thereby controlling the shot load separation and enhancing the shot pattern.

20 Claims, 10 Drawing Sheets

(56) References Cited

U.S. PATENT DOCUMENTS

| | | | | |
|---|---|---|---|---|
| 2004/0211292 | A1* | 10/2004 | Buenemann, Jr. ..... | C22C 33/02<br>75/338 |
| 2013/0228090 | A1 | 9/2013 | Billings | |

* cited by examiner

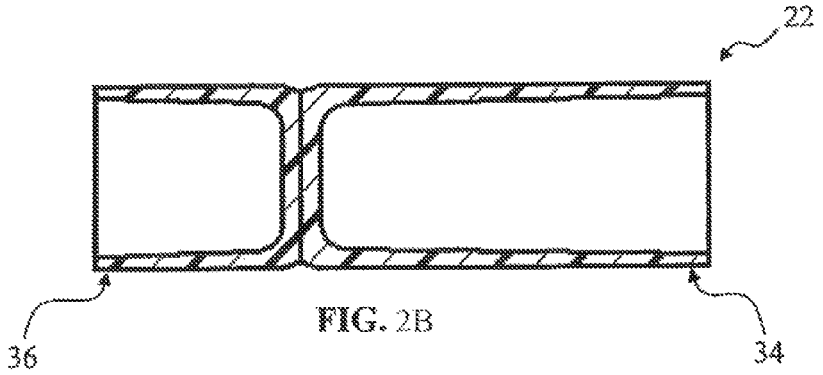
FIG. 2B
22
FIG. 3A
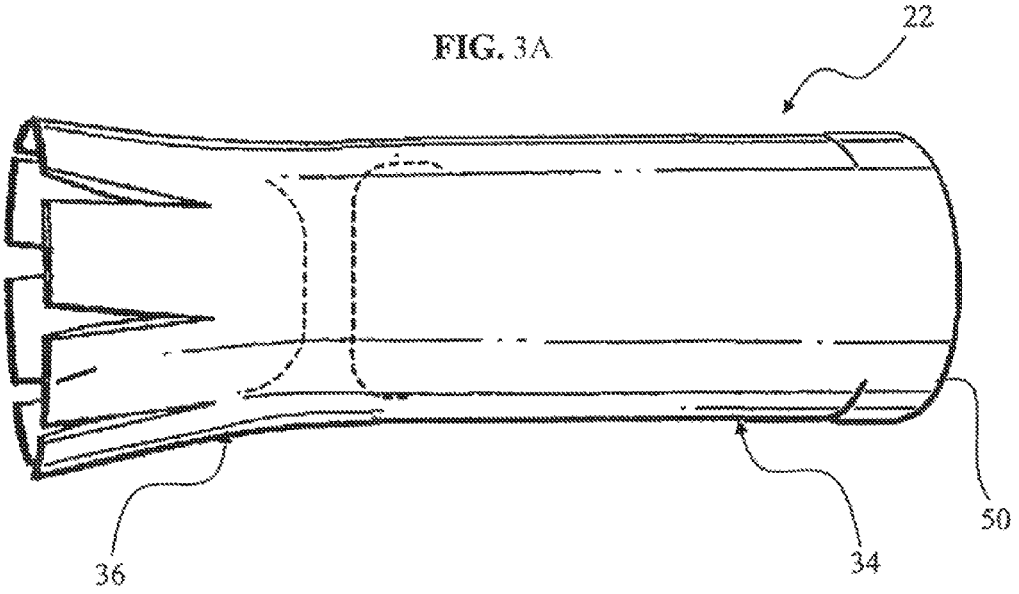

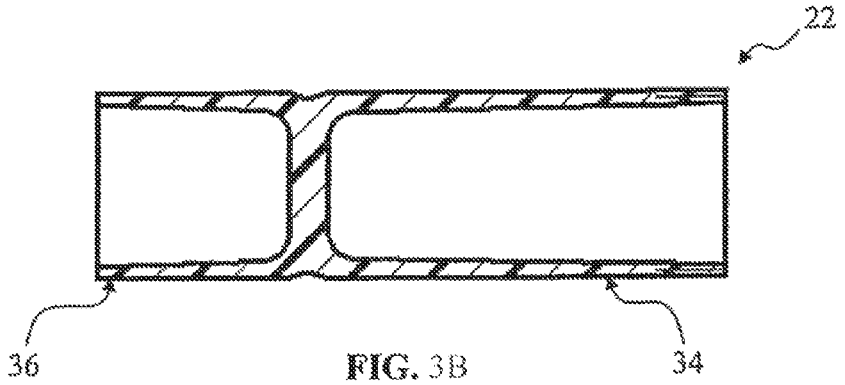
FIG. 3B
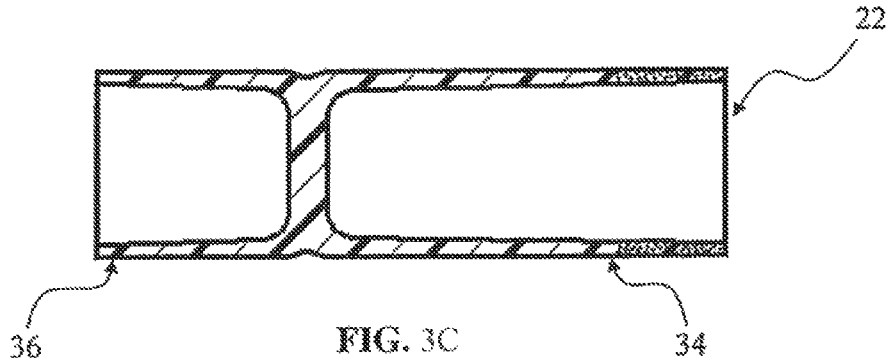
FIG. 3C
FIG. 4
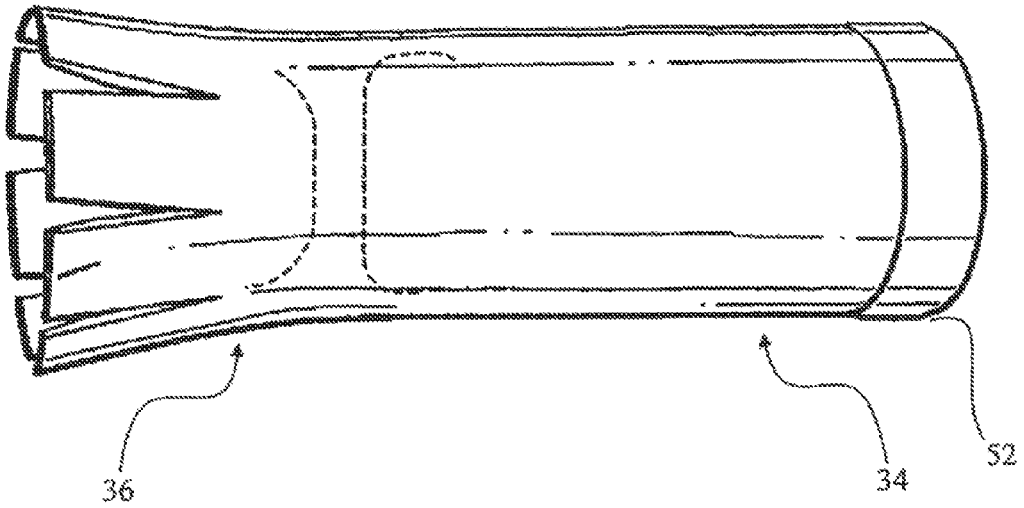

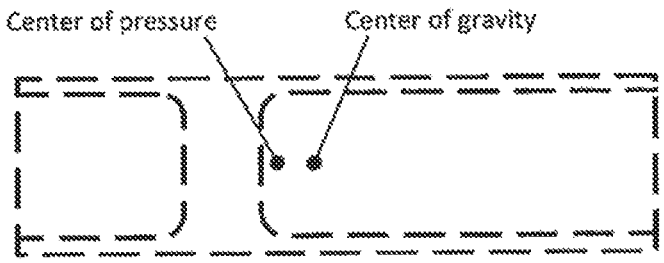
PRIOR ART FIG. 11A
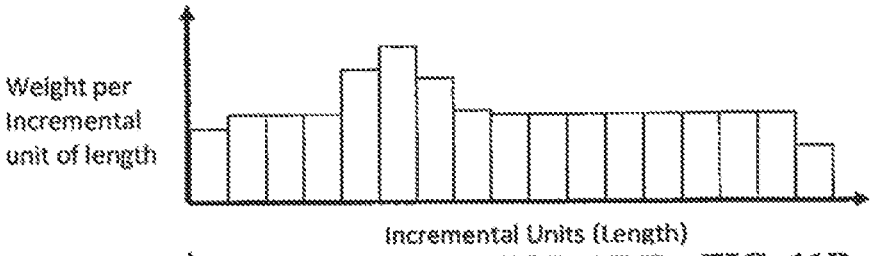
PRIOR ART FIG. 11B
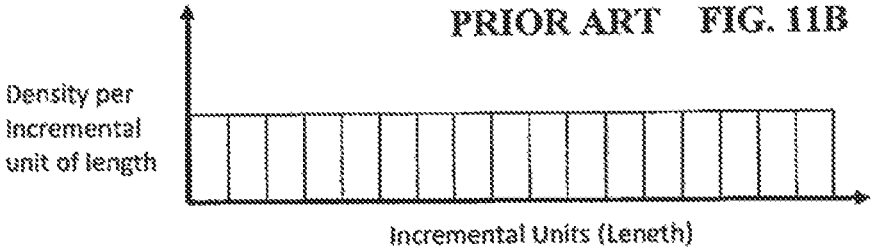
PRIOR ART FIG. 11C

SHOTGUN SHELL

RELATED APPLICATION

The present application is a continuation of U.S. patent application Ser. No. 13/683,795, filed on Nov. 21, 2012, which claims the benefit of U.S. Provisional Patent Application No. 61/562,361, filed on Nov. 21, 2011, all of which are incorporated herein in their entireties by reference.

FIELD OF THE INVENTION

The present invention is generally directed to a wad for containing and deploying shot from a shotgun cartridge. Specifically, the present invention is directed to a wad having weighting elements for axially shifting the center of gravity of the wad and correspondingly the separation between the wad and the shot load.

BACKGROUND OF THE INVENTION

Shotgun cartridges typically comprise a propellant charge, a wad and a shot load, all of which are contained within a plastic or paper shell reinforced at one end with a metal case head to contain and direct the created propellant gases through the opposite end of the cartridge. The shotgun wad typically comprises a polymer or fabric body that obturates against the barrel during firing to prevent escape of propellant gases around the slug or through the shot. The wad often comprises a forward facing cup portion or wings that contains the shot or slug as the shot travels through the barrel. Upon exiting the barrel, aerodynamic drag on the cup or the flaring of the wings slows the wad separating the wad from the slug or shot and freeing the projectile(s) to travel onto the target alone.

A primary consideration is determining the performance of a shot loaded shotgun cartridge is determining the maximum effective range at which there is sufficient shot density to accurately strike a target. A standard measurement for determining the effective range of the shotgun cartridge is patterning or measuring the percentage of shot that strikes within a 30 inch circle at 40 yards or other predetermined distance. The tightness of the pattern or the percentage of shot that strikes within the circle can be affected the size and shape of the shot, the size of the propellant load and the separation point between the wad and the shot. For the purposes of this disclosure, the separation point is the point during flight in which wad dispenses the shot load from the cup portion.

In particular, the conventional understanding of the effect of the wad on patterning of the shot load is that the longer the wad remains with the shot during flight, the greater the likelihood that the wad will worsen the patterning of the shot load or produce an irregular shot pattern. Wads are typically designed to incur significant aerodynamic drag upon leaving the muzzle through a forward facing cup portion or flaring wings that slow the wad while the shot and slug continues onto the target. The intentionally poor aerodynamic qualities of the wad can cause the wad to tumble or veer off the desired trajectory. The greater the distance of the separation point from the muzzle the more likely that the wad may negatively impact the trajectory of the shot or the slug. As a result, the wad is typically designed to have a separation point as close to the end of the muzzle as possible.

In certain wads, the wad is commonly formed by folding four separate wings together to define the walls of the cup. The wings flare open immediately upon leaving the muzzle to slow the wad and release the load as soon as possible. Similarly, certain shotgun chokes, such as disclosed in U.S. Pat. No. 7,523,581, slow the wad as the wad passes the choke to begin to separate the shot from the load even before the wad exits the muzzle. In both configurations, the wad is rapidly slowed to facilitate a separation point as close to the muzzle of the barrel as possible.

A similar consideration is that different shot patterns and densities are required for different uses. A choke is typically placed at the muzzle of the shotgun to set the rate at which the shot expands to control the resulting shot pattern. Different chokes are used to create different shot patterns. However, because the choke is positioned at the muzzle of the shotgun, a conventional choke may not sufficiently constrict the shot pattern such that the desired shot pattern is obtained. Certain shotgun cartridges, such as disclosed in U.S. Pat. No. 7,243,603, contain a shot container for receiving the shot and placed within the wad. Upon firing, the shot container is released from the wad and travels a distance with the shot retained within the container before dispensing the shot to expand radially. However, the shot container adds an additional feature to the manufacturing of the shotgun cartridges and can also potentially negatively influence the resulting shot pattern. In addition, the container occupies space within the already limited dimensions of the shotgun cartridge that could be otherwise used for the propellant charge or shot load.

The conventional understanding in the art is that the wad is a hindrance to achieving the desired shot patterning. However, the conventional means of controlling the shot pattern are not always sufficient to provide the desired shot pattern.

SUMMARY OF THE INVENTION

The present invention is generally directed to a shotgun wad having a weighted front end that shifts the center of gravity of the wad axially forward toward the nose end of the wad. Each wad can comprise a nose portion defining a forward facing cup portion for receiving a shot load and a tail portion defining a rear facing cup portion interfacing with a propellant charge. The forward weighting of the wad and overall increased weighting of the wad increases aerodynamic stability and the momentum of the wad such that the wad maintains its initial trajectory for a greater distance before aerodynamic drag causes the wad to tumble or veer off the initial trajectory. The improved aerodynamic stability allows for a delayed separation point between the wad and the shot providing denser patterning down range. In one aspect, the improved stability can also reduce the tumbling or oscillation of the wad in flight, which can alter the shot pattern as the shot load is dispensed from the wad providing inconsistent or uneven patterning.

The forward weighting of the center of gravity of a wad, according to an embodiment of the present invention, creates an increased axial separation between the center of gravity and the center of pressure improving the overall stability of the wad. For the purposes of this disclosure, the center of pressure is the average location of the air pressure acting on the wad as the wad travels through the air. The conventional understanding is that the forward center of gravity is provided by the shot load and the most effective way of improving the wad stability is to move the center of pressure rearward as shown in U.S. Pat. No. 3,516,360, which is herein incorporated by reference in its entirety. The inherent drawback is that as the shot load is dispensed from the wad cup, the center of gravity of the wad shifts rearward decreasing the aerodynamic stability of the wad. It has been discovered to be advantageous to front weight the wad itself to avoid a significant loss of stability as the shot load is dispensed from the wad and the overall center of gravity of the wad and contents combination (after the shot load departs) shifts rearward.

Similarly, the weight distribution of conventional wads is typically governed by thickness of the portion of the wad between the forward facing cup containing the shot load and the rear facing cup interfacing with the propellant charge. The thickness of the intermediate portion is often varied as a space filling or saving technique after the overall length of the cartridge, type of shot load, the size of the propellant charge, type of propellant, the weight ratio of the shot load to the propellant charge and other factors are varied to affect some aspect of the cartridge performance. In particular, target load cartridges that typically comprise with lighter shot loads and smaller propellant loads can comprise thick tail portions to fill the empty space within the projectile shifting the center of gravity of the wad rearward and lowering the aerodynamic stability of the wad. Accordingly, the front weighting of the wad itself improves the aerodynamic stability of the wad even if the tail portion is varied to fill or make space within the cartridge.

The extended flight along the initial trajectory positions the separation point at a greater distance from the barrel. In contrast to the conventional understanding, maintaining the wad with the shot to a separation point further from the barrel muzzle does not negatively influence the shot pattern and instead advantageously provides denser patterning at longer ranges. In one aspect, the reduced tumbling from the axial separation also eases the separation of the wad from the shot load providing the advantage of denser patterning further down range provided by a delayed separation point while avoiding the negative effect of a wad beginning to tumble or veer off trajectory as the shot load is separating from the wad.

In one aspect, the weighted shotgun wad can comprise a molded nose portion and a separately molded tail portion. In this configuration, the nose and tail portions can each comprise generally tubular cup shapes wherein the closed end of each cup are affixed together to define a wad having a forward facing cup and a rear facing cup. The nose portion can be molded from a different material from the tail portion, wherein the nose portion comprises a higher density material than the tail portion. The more heavily weighted nose portion shifts the center of gravity axially forward relative to the center of pressure as compared to similarly shaped wads molded as a unitary body or of the same material throughout. In this configuration, nose portions comprising different weighting can be provided and affixed to the tail portion allowing tailoring of the separation point by adjusting the relative axial separation of the center of gravity and center of pressure. The customizability of the wad provides the added advantage of allowing the wad to be tailored for different shot sizes and propellant loads to optimize the separation point for the desired shot patterning. The interchangeability of the nose and tail portions of the shotgun wad also simplifies the manufacturing process as only a single type of tail portions must be manufactured.

In one aspect, the wad can be molded as a single unitary body with a weighted ring portion molded or fitted to the nose portion of the unitary body. In one aspect, the weighted ring can be overmolded onto the nose portion of the same material to provide additional material at the tip of the nose portion for shifting the weighting of the unitary body. Alternatively, the ring can comprise a different denser material overmolded, adhered or otherwise affixed to the nose portion of the unitary body. In this configuration, the ring can comprise a polymer, a metal, a composite material or other denser material for providing a front weighted nose portion. The ring can have an increased axially length to provide additional material for increasing the weight at the front end of the wad.

In one aspect, the wad can be molded as a single unitary body with a rearward portion of the nose portion overmolded over a weighted forward ring portion of the nose portion. In embodiments either one of the nose portion and the tail portion may be overmolded on the other of the nose portion and tail portion, forming a unitary wad. In embodiments, each of the nose portion and the tail portion comprise a specific polymer of like polymer to facilitate the adhesion of the nose portion and the tail portion.

The inventions herein are applicable to existing configured wads to increase the range, to vary the pattern density or to allow providing a variety of differently performing shotgun shell cartridges by changing the wad to a like configured wad only with different weighting characteristics. For example, in a known wad, aspects of the inventions herein are applicable to wads with a tail portion comprising fin slits cut into the end of the tail portion such that the end opens into a plurality of rearward extending fins once the wad leaves the muzzle. The fins open as the wad leaves the muzzle to extend radially outward and axially rearward stabilize the wad in flight such that the wad flies straight through the air. Adding forward weighting can further enhance the flight characteristics and shot gun shell performance. Also, known wads have nose portions with a u-shape cut that opens into a flap that allows the elongated walls of the nose portion to flex as the wad travels through the barrel and the air. The flexing of the elongated walls dislodges any shot wedged into the cup portion from the initial acceleration of the wad during firing. Although such configurations typically move the center of pressure forward on the wad, forward weighting by the techniques disclosed herein can still provide performance enhancement. Other known wad configurations, by utilizing forward weighting techniques disclosed herein may also have there performance enhanced and provide manufacturing advantages such as easily providing series of differently performing shotgun shell cartridges by simply providing different forward weighting configurations.

A method for making a wad, according to an embodiment of the present invention, can comprise pre-molding the nose portion from a first material before molding the tail portion over a portion of the nose portion from a second material. Alternatively, the tail portion can be pre-molded from the second material before the nose portion is over-molded onto the tail portion from the first material According to an embodiment, the nose portion and the tail portion can be separately molded and fitted together such that the nose and tail assemblies can separate during flight. The first material can comprise a stiff and dense polymer or lightweight metal. The second material can comprise a polymer that is lighter than the first material such that the center of gravity is shifted toward the front of the nose. Depending on the desired separation point, the relative difference in weight between the first polymer and the second material can be adjusted to customize the separation point. As the tail and nose portion are separately formed, the tail portion can be standardized while the nose assemblies can be varied to have different separation points to have different resulting shot patterns. The modular design provides significant manufacturing advantages as the tail portion can be standardized.

A method for making a wad, according to an embodiment of the present invention, can comprise pre-molding the wad, wherein the wad comprises a nose portion and a tail portion. In one aspect, the nose portion and tail portion can be separately molded and fitted together. In another aspect, the nose and tail portions can be molded together as a single unitary body. The method can further comprise fitting a weighting ring to the nose portion of the wad. In one aspect, the weighting ring can be overmolded onto the nose portion 34. In another aspect, the weighted ring can be separately molded or manufactured and adhered or otherwise affixed to the nose portion of the wad. The method can also comprise varying the weight of the ring to tailor the separation point of the wad from the shot.

In embodiments, overmolding one of (a first component) the tail portion and nose portion to the other (second component) of the tail portion and nose portion, the first component can have structure, such as a protruding flange, such that the overmolded second component has a mechanical connection formed by the overmolding process.

Embodiments of the invention include coinjection molding the nose portion and the tail portion, with the nose portion and the tail portion comprising different formulations whereby the nose portion is denser than the tail portion. In such embodiments, the nose portion may be a first formulation and the tail portion a second formulation with the first formulation being denser than the second formulation. In embodiments both formulations are polymers. In embodiments both formulations comprise a common polymer thereby assuring adhesion between the two formulations.

Embodiments of the invention include coinjection molding portions of the nose portion defining a weighted nose portion with the rest of the nose portion and the tail portion, with the weighted portion of the nose portion comprising a first formulation and the balance of the nose portion and the tail portion comprising a second formulation with the first formulation being denser than the second formulation. In embodiments both formulations are polymers. In embodiments both formulations comprise a common polymer thereby assuring adhesion between the two formulations.

Particular embodiments of the invention provide a method of manufacturing shot gun cartridges that vary the shot pattern, particularly the shot spread at desired distances, by altering only the wadding in a shotgun shell and maintain all other configurations and quantities the same. That is, by providing a particular shotgun shell with differently weighed wads, the separation time is varied, the stability of the flight may be enhanced, and extended and the shot pattern varied as desired. In embodiments, the weight of conventional wad material, such as polyethylenes, have a specific gravity of less than 1.0, typically less than 0.975. By adding filler material, the specific gravity can be increased by, for example 10%, to 1.1 or greater. Fillers may be conventional fillers used in injection plastic molding, glass fibers, carbon, carbon fibers, steel, iron particles, or other materials may be used that increase the specific gravity of the material. In embodiments the entire wad material may have such a fillers or fillers, increasing the entire weight of the wad. In embodiments, just the nose portion, or a forward portion of the nose portion may be filled with such. Thus, particular embodiments of the invention include shotgun shell wads formed of polyethylene filled thereby increasing the density and weight of the nose portion or forward portion of the nose portion; in embodiments, the entire length of the wad may utilize the polyethylene filled with the weighting material. In other embodiments, polymers may be selected that have a density greater than 1.0 and utilized for the nose portion or a forward portion of the nose portion, in conjunction with an attached tail portion. In other embodiments, the nose portion may be a blended polymer or copolymer formed of the material of the tail portion, and another more dense polymer, thereby increasing the weight of the nose portion, moving the center of gravity forward in the wad, and delaying separation of the wad and the shot load after firing, enhancing the stability of the wad during flight, thereby enhancing the shot pattern and generally increasing the range of the shotgun shell cartridge.

Particular embodiments of the invention provide a method of tightening and/or uniformizing the shot patterns of shot gun shell cartridges by extending the time (and distance) that the wad with the shot cup stays in engagement with the shot. In embodiments, this is accomplished by increasing the density of the material of the wad at the nose portion or at the forward portion of the nose portion, thereby increasing the weight of the nose portion and thereby moving the center of gravity of the wad forward.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which:

FIG. 2B is a cross sectional view of the wad of FIG. 2A.

FIG. 3A is a perspective view of a shotgun wad according to an embodiment of the present invention, wherein the shotgun wad comprises a weighting element on a nose portion of the wad.

FIG. 3B is a cross sectional view of the shotgun wad of FIG. 3A with a weighted band at the forward end of the nose portion.

FIG. 3C is a cross sectional view of a shotgun wad illustrating weighted filler material in a forward portion of the nose portion.

FIG. 4 is a perspective view of a shotgun wad according to an embodiment of the present invention, wherein the shotgun wad comprises a weighting ring on a nose portion of the wad.

FIG. 11A is a side pictorial view of a PRIOR ART shotgun wad.

FIG. 11B is a chart illustrating weight per unit of length of the PRIOR ART wad of FIG. 11A.

FIG. 11C is a chart illustrating density per unit of length of the PRIOR ART wad of FIG. 11A.

Figure 1:
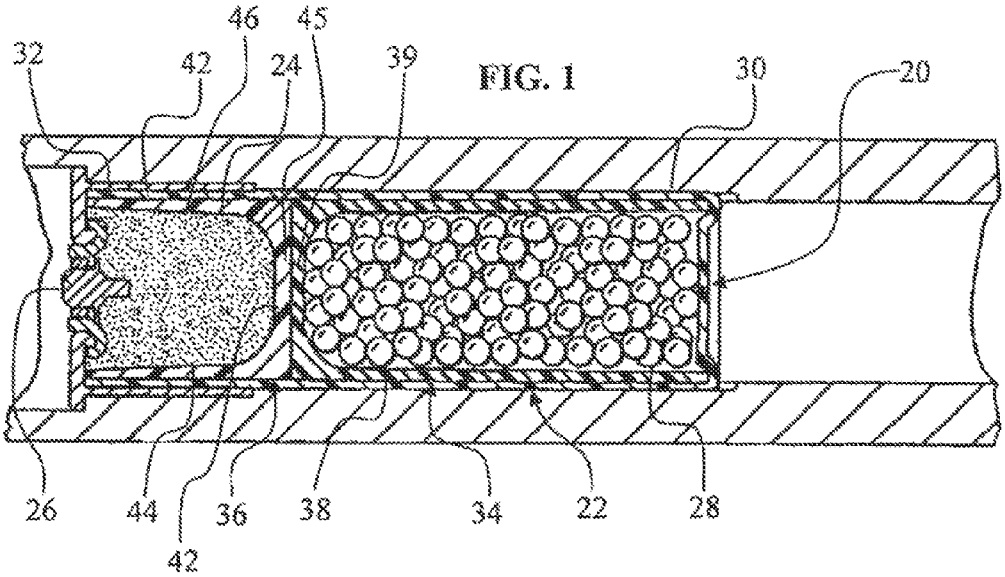
FIG. 1 is a cross-sectional side view of a shotgun wad according to an embodiment of the present invention positioned within a shotgun cartridge.
Figure 2A:
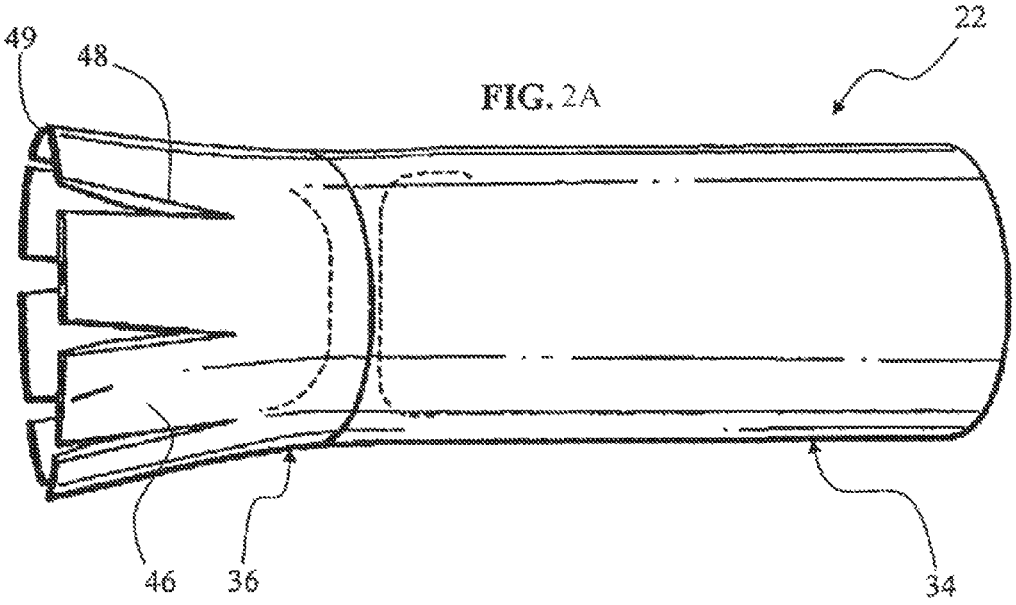
FIG. 2A is a perspective view of a shotgun wad according to an embodiment of the present invention, wherein the shotgun wad comprises a nose portion and bottom portion that can be separately molded and affixed together.
Figure 5:
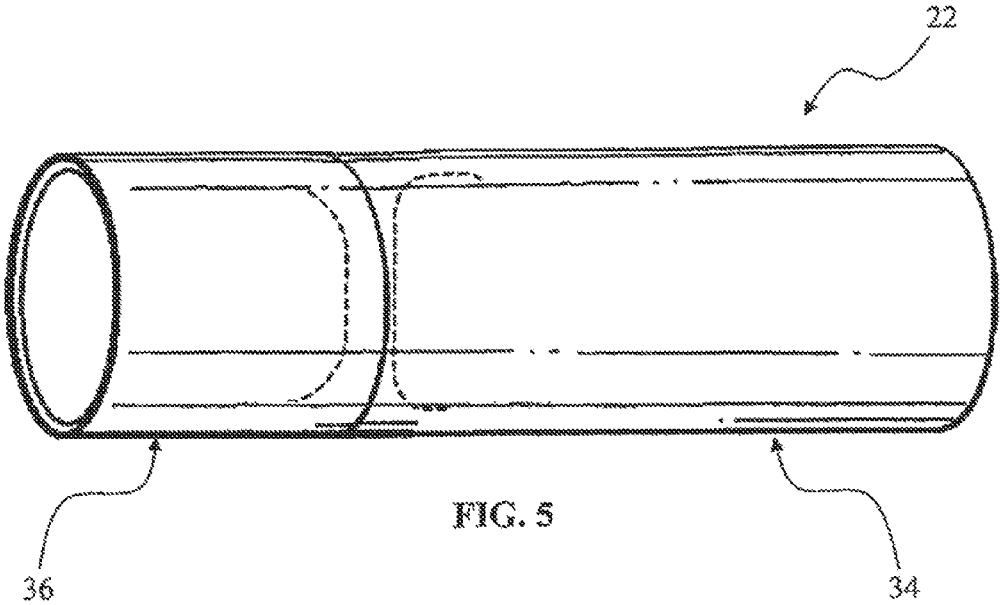
FIG. 5 is a perspective view of a shotgun wad according to an embodiment of the present invention, wherein the shotgun wad comprises a nose portion and bottom portion that can be separately molded and affixed together.
Figure 6:
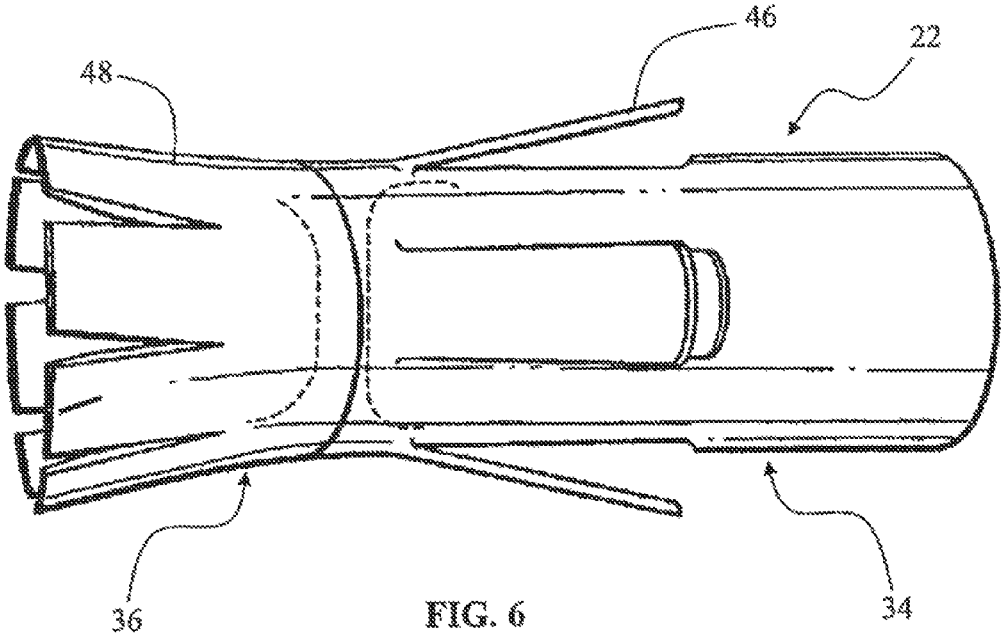
FIG. 6 is a perspective view of a shotgun wad according to an embodiment of the present invention, wherein the shotgun wad comprises flaps forward facing for assisting in the release of shot.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

As shown in FIGS. 1-2B, 7, 8, 12A, and 13A a shotgun cartridge 20, according to an embodiment of the present invention, comprises a wad 22, a propellant charge 24 with a primer 26 and a shot load 28 all contained within a shell 30 reinforced at one end with a case head 32. The wad 22 can further comprise a nose portion 34 and a tail portion 36. The nose portion 34 comprises a tubular wall 38 and webbing 39 providing a closed rearward end and defining an elongated forward facing cup 40 for receiving the shot load 28. As depicted, the shot load 28 comprises a plurality of shot. Alternatively, in some embodiments the cup can receive a slug. The tail portion 36 comprises a tubular shaped wall 44 with webbing 45 forming a closed end 42 that can be seated against the propellant charge 24. In one aspect, the tail portion 42 can define a rear facing cup portion 46 for capturing propellant gases generated by the ignited propellant charge 24 and obturating against the walls of barrel to prevent the gases from escaping around the wad 22. Generally, the nose portion 34 is affixed to, including unitary with, the tail portion 36 to define a generally tubular body having a central axial axis a-a extending longitudinally through the center of the tubular body. The wad 22 is symmetrical such that the center of pressure of the wad 22 is positioned along the central axial axis a-a.

Figure 7:
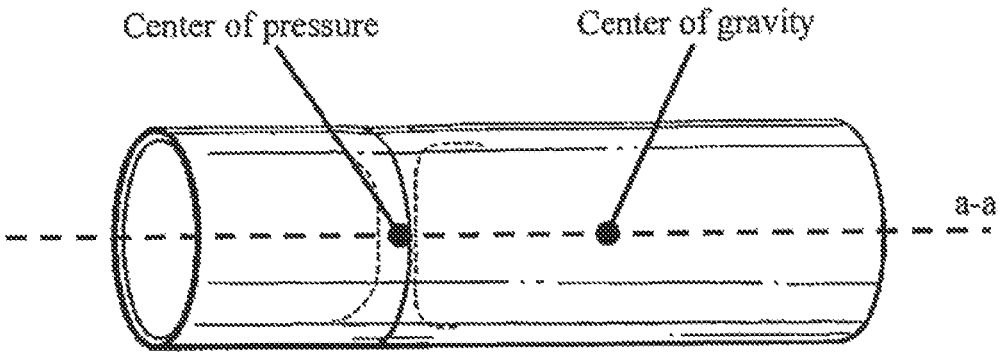
FIG. 7 is a perspective view of a shotgun wad illustrating the relative positioning of the center of gravity axially forward of the center of pressure from a front weighted nose portion.
Figure 8:
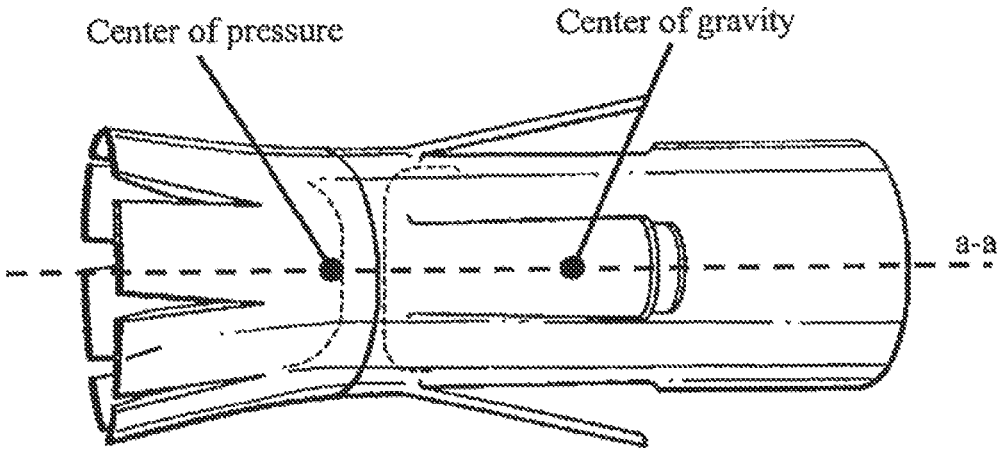
FIG. 8 is a perspective view of a shotgun wad illustrating the relative positioning of the center of gravity axially forward of the center of pressure from a front weighted nose portion having flaps and a tail portion having fins.

According to an embodiment, the tail portion 42 can comprise at a plurality of fins 46 defined by slits 48. The fins may provide obturation with the barrel upon firing and the ends 49 of the fins flare radially outward as the wad 22 leaves the muzzle of the gun to engage the air and stabilize the wad 22 during flight. In one aspect, the fins 46 can move the center of pressure rearward axially relative to the center of gravity to further improve the aerodynamic stability of the wad 22 as depicted in FIG. 7. According to an embodiment, the tail portion 42 can also define at least one flap 48 that also flares outwardly and forward as the wad 22 leaves the gun muzzle. The flap 48 allows the elongated side wall 38 defining the cup 40 to flex as the flap 48 travels through the barrel and in flight. The flexing of the cup 40 dislodges any portion of the shot load 28 that is wedged in the bottom of the cup 40 from the initial acceleration of the wad 22 during firing. The propellant charge 24 can further comprise a primer 30 for igniting the propellant. In embodiments, the flaps 46 can introduce aerodynamic drag moving the center of pressure rearward axially relative to the center of gravity to further improve the aerodynamic stability of the wad 22 as depicted in FIG. 8.

In embodiments, the nose portion 34 can comprise a first material, while the tail portion 36 can comprise a second material, wherein the first material has a higher density than the second material to shift the center of gravity of the wad 22 forward axially toward the nose end of the wad 22 away from the center of pressure of the wad 22 compared to the position of the center of gravity in the configuration where the first material is the same as the second material. In embodiments, the first material can comprise a density of at least 0.90 g/cm$^3$. In another embodiments, the first material can comprise a density of at least 0.95 g/cm$^3$. In yet another aspect, the first material can comprise a density between about 0.90 g/cm$^3$ and about 1.00 g/cm$^3$. In embodiments, the first material will have a density at least 5% higher than the second material. In embodiments, the first material will have a density at least 10% higher than the second material. In embodiments, the first material will have a density at least 20% higher than the second material. In embodiments, the first material will have a density at least 40% higher than the second material. In embodiments, the first material will have a density at least 100% higher than the second material. In embodiments, both the first and second material can comprise high density polyethylene polymers and copolymers of varying densities as well as other durable polymers.

In embodiments, the nose portion 34 can comprise a weight 10% greater than the tail portion 36. Alternatively, at least 5% more of the total weight of the wad 22 is positioned in the nose portion 34 than the tail portion 36. In another aspect, the nose portion 34 can comprise a weight 20% greater than the tail portion 36. Alternatively, at least 10% more of the total weight of the wad 22 is positioned in the nose portion 34 than the tail portion 36. In yet another aspect, the nose portion 34 can comprise a weight 30% greater than the tail portion 36. In this configuration, at least 15% more of the total weight of the wad 22 is positioned in the nose portion 34 than the tail portion 36.

In embodiments, the total weight of the wad 22 can comprise at least 50 grains for a 2¾ inch 12 gauge shotgun cartridge 20, with the nose portion 34 weighing more than the tail portion 36. In another aspect, the wad 22 can weigh at least 55 grains for a 2¾ inch 12 gauge shotgun cartridge 20, with the nose portion 34 weighing more than the tail portion 36. In yet another aspect, the wad 22 can weigh at least 55 to 60 grains for a 2¾ inch 12 gauge shotgun cartridge 20, with the nose portion 34 weighing more than the tail portion 36. In this configuration, the nose portion 34 can weigh about 5 to 15 grains more than the tail portion 36. A person of ordinary skill in the art can appreciate that the overall weight of the wad 22 can increase or decrease proportionally for different cartridge 20 diameters including, but not limited to 0.410 gauge, 20 gauge, 16 gauge and 10 gauge. Similarly, a person of ordinary skill in the art can appreciate that the overall weight of the wad 22 can increase or decrease proportionally for different cartridge 20 lengths including, but not limited to 3 inch and 3½ inch cartridges 20.

In embodiments, the center of gravity of the wad will be closer to the leading edge than the trailing edge. In embodiments, the center of gravity will be shifted at least 5% of the length of the wad forward compared to a wad of the same shape where the nose portion and tail portion are formed of the same material. In embodiments, the center of gravity will be shifted at least 10% of the length of the wad forward compared to a wad of the same shape where the nose portion and tail portion are formed of the same material. In embodiments, the center of gravity will be shifted at least 20% of the length of the wad forward compared to a wad of the same shape where the nose portion and tail portion are formed of the same material. In embodiments, the center of gravity will be shifted at least 30% of the length of the wad forward compared to a wad of the same shape where the nose portion and tail portion are formed of the same material.

In embodiments, the nose portion 14 and tail portion 16 are adapted to be modular such that different nose portions 14 having different weights can be fitted to a tail portion 16 having a consistent weight such that the separation point between the wad 4 and the load 8 can be optimized for the particular load 8 and/or use for the cartridge 2. In this configuration, the nose portion 34 and tail portion 36 can be affixed together with adhesive, molding or other conventional means of securing the nose and tail portions 34, 36 together. The first material can comprise a durable polymer resistant to splitting of the side wall 38, which cause the side walls 38 to petal and slow the wad 22 causing premature separation of the shot load 28 from the wad 22. In one aspect, the fins 46 of the tail portion 36 can cooperate with the axial separation of the center of gravity and the center of pressure to maintain the trajectory of the wad 22 along the initial trajectory of the wad 22 as the wad 22 leaves the muzzle of the barrel.

As depicted in FIG. 3A, 3B, 4, in embodiments, the nose portion 34 can further comprise at least one weighting element 50 comprising a third material different from the first material used in the nose portion 34 and second material used in the tail portion 36. The weighting element 50 can be molded with, molded over, or adhered onto the nose portion 34. The weighting element 50 positioned on the nose portion 34 shifts the center of gravity of the wad 22 forward axially away from the center of pressure of the wad 22 compared to a wad without the weighting element. In one aspect, the weighting element 50 can comprise between 5% and 20% of the total weight of the wad 22. FIG. 3C illustrates where weighted filler material 51 is added to the polymer material of the forward portion of the nose portion.

As depicted in FIG. 4, in embodiments, the wad 22 can further comprise at least one weighting ring 52 fitted to the nose portion 34. The weighting ring 52 can comprise a fourth material different from the first and second material, wherein the fourth material is denser and heavier than the first and second materials. The weighting ring 52 can comprise a polymer, metal or composite material. The weighting ring 52 can be overmolded, adhered or other affixed to the nose portion 34 of the wad 22. In one aspect, the weighting ring 52 can comprise between 5% and 20% of the total weight of the wad 22.

In operation, the propellant is ignited by the primer 26 and the created gasses expand behind the tail portion 36 of the wad 22 to push the wad 22 and load 28 down the barrel. Unlike conventional wads that separate from the load immediately upon exiting the muzzle, the wad 22 remains with the load 28 until a predetermined distance from the muzzle is reached. The relative weight of the nose portion 34 to the tail portion 36 can be adjusted by changing the relative weight of the nose portion 34 to the tail portion 36. The greater the weight of the nose portion 34 relative to the tail portion 36, the further the separation point is from the muzzle. Similarly, the closer the relative weights of the nose portion 34 and the tail portion 36, the closer the separation point is from the muzzle.

Figure 9:
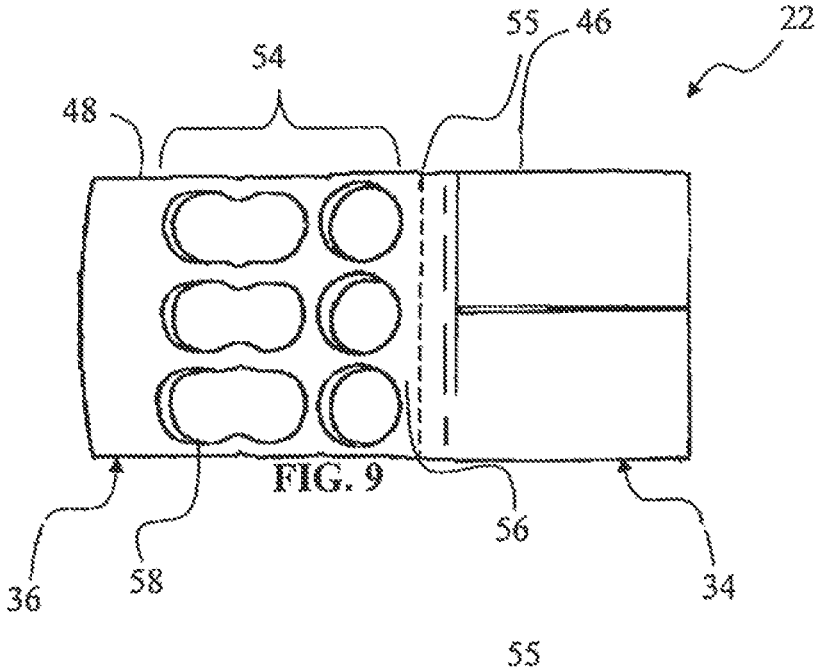
FIG. 9 is a perspective view of a shotgun wad having a cushioning assembly according to an embodiment of the present invention.
Figure 10:
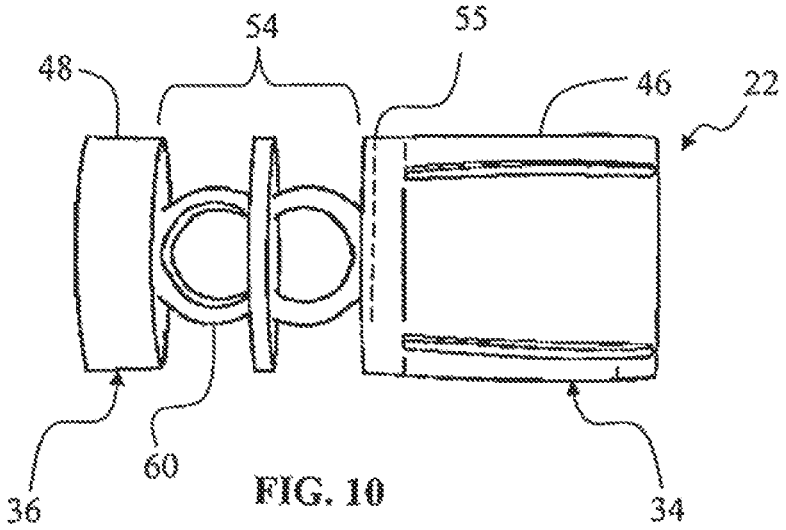
FIG. 10 is a perspective view of a shotgun wad having a cushioning assembly according to an embodiment of the present invention.
Figure 12A:
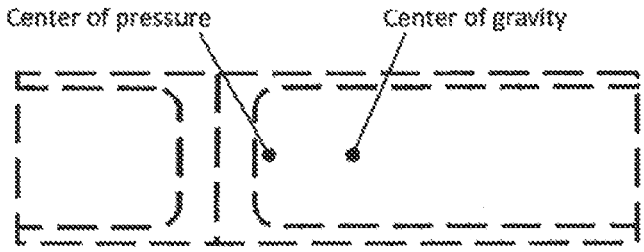
FIG. 12A is a side pictorial view of a shotgun wad in accord with the invention.
Figure 12B:
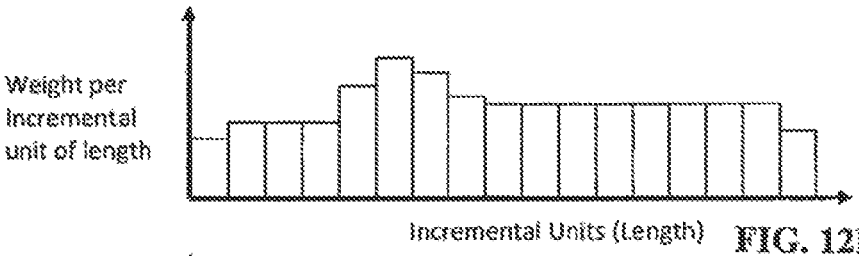
FIG. 12B is a chart illustrating weight per unit of length of the shotgun wad of FIG. 12A.
Figure 12C:
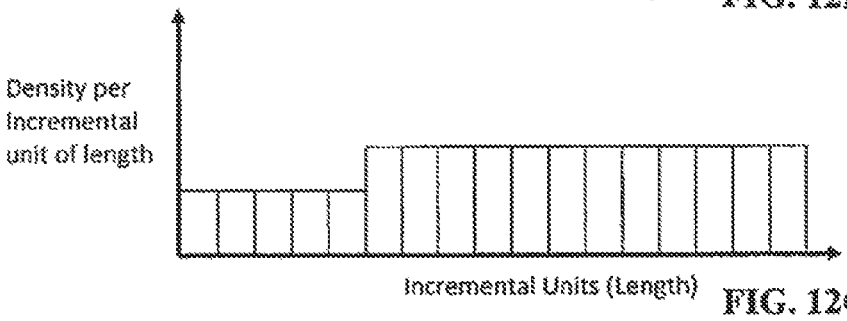
FIG. 12C is a chart illustrating density per unit of length of the PRIOR ART shotgun wad of FIG. 12A.
Figure 13A:
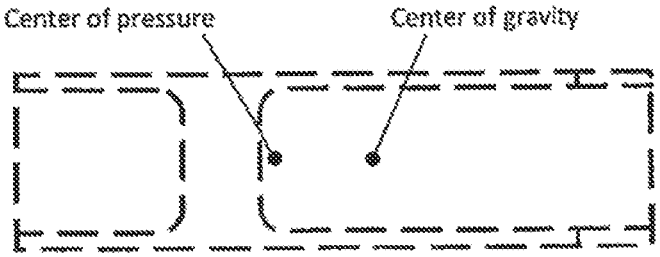
FIG. 13A is a side pictorial view of a shotgun wad in accord with the invention.
Figure 13B:
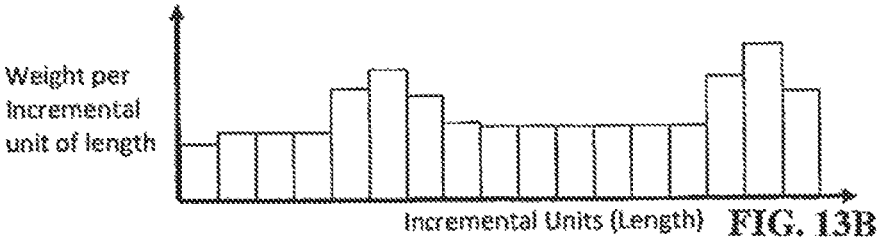
FIG. 13B is a chart illustrating weight per unit of length of the shotgun wad of FIG. 13A.
Figure 13C:
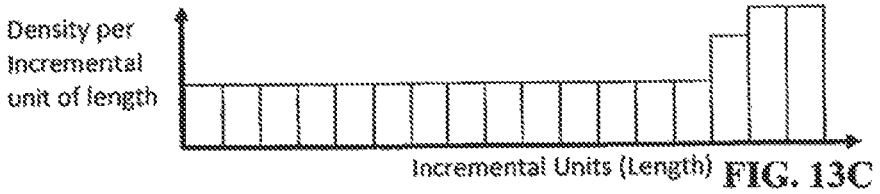
FIG. 13C is a chart illustrating density per unit of length of the shotgun wad of FIG. 13A.

As depicted in FIGS. 9-11C, embodiments, the wad 22 can further comprising a cushioning assembly 54 positioned between the nose portion 34 and the tail portion 36. The cushioning assembly 54 is adapted to compress during firing to facilitate efficient acceleration and firing of the shot load 28. As depicted in FIG. 9, in one aspect, the cushioning assembly 54 comprises a plurality of elongated struts 56 having pre-formed crimps for facilitating flexing of the struts 56 during firing of the cartridge 20. As depicted in FIG. 9, in one aspect, the cushioning assembly 54 defines a plurality of openings 58 that collapse during firing to facilitate the flexing of the cushioning assembly 54 during firing of the cartridge 20. As depicted in FIG. 10, in one aspect, the cushioning assembly 54 comprises a plurality of rings 60 that collapse during firing to facilitate the flexing of the cushioning assembly 54 during firing of the cartridge 20. The embodiments of FIGS. 12A-13C, illustrate forward weighting provided to known configurations of wads forward of the dashed lines identifying the demarcation 55 between a portion of the nose portion with the weighted formulation and the rest of the nose portion and wad.

A method for making a wad 22, according to an embodiment of the present invention, can comprise pre-molding the nose portion 34 from a first material before molding the tail portion over a portion of the nose portion 34 from a second material. Alternatively, the tail portion 36 can be pre-molded from the second material before the nose portion 34 is over-molded onto the tail portion 36 from the first material. According to an embodiment, the nose portion 34 and the tail portion 36 can be separately molded and fitted together such that the nose and tail assemblies 34, 36 can separate during flight.

A method for making a wad 22, according to an embodiment of the present invention, can comprise pre-molding the wad 22, wherein the wad 22 comprises a nose portion 34 and a tail portion 36. In one aspect, the nose portion 34 and tail portion 36 can be separately molded and fitted together. In another aspect, the nose and tail portions 34, 36 can be molded together as a single unitary body. The method can further comprise fitting a weighting ring 52 to the nose portion 34 of the wad 22. In one aspect, the weighting ring 52 can be overmolded onto the nose portion 34. In another aspect, the weighted ring 52 can be separately molded or manufactured and adhered or otherwise affixed to the nose portion 34 of the wad 22. The method can also comprise varying the weight of the ring to tailor the separation point of the wad 22 from the shot load 28.

FIGS. 11A, 11B, 11C, 12A, 12B, 12C, 13A, 13B, and 13C illustrate the weight gradients and density gradients of embodiments of the invention and the prior art. Adding weight to the nose portion, including at the forward tip of the nose portion provides separation and forward placement of the center of gravity of the wad compared to non added weight versions. Such increases the stability during flight and increases the delay in separation of the wad with the shot load.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A shotgun cartridge for dispensing a shot load at a predetermined distance from a muzzle of a firearm, comprising:

a shotgun cartridge casing having a forward end and a rearward end closed by a case head;

a primer installed in the case head;

a propellant charge in the case head;

shot positioned at the forward end; and a wad separating the propellant charge from the shot, the wad having a central axis and comprising a nose portion and a tail portion separated at an interface, the interface extending normal to the central axis and extending entirely through the wad, the nose portion defining a forward facing cup portion holding the shot, the tail portion defining a rearward facing cup portion holding the propellant charge, the tail portion not extending forwardly beyond the interface and the nose portion not extending rearwardly beyond the interface, the entirety of the nose portion comprising a first polymer and the entirety of the tail portion comprising a second polymer different from the first polymer, the nose portion first polymer denser than the tail portion second polymer, the nose portion unitary with the tail portion by one of coinjection molding and overmolding.

2. The shotgun cartridge of claim 1, wherein first material has a density between about 0.90 g/cm$^3$ and about 1.00 g/cm$^3$ and the first material is at least 5 percent denser than the second material.

3. The shotgun cartridge of claim 1 wherein there is an interface between the nose portion and the tail portion and said interface is axially positioned between the forward facing cup portion and the rearward facing cup portion.

4. The shotgun cartridge of claim 1 wherein the nose portion further comprises metal.

5. The shotgun cartridge of claim 1 wherein the wad has a length and a center of gravity positioned along the length, and wherein the center of gravity is positioned at least 10% of the length forward of a location of where a center of gravity would be if the first material and second material were of the same density.

6. The shotgun cartridge of claim 1 wherein there is an interface between the nose portion and the tail portion and said interface is axially positioned between the forward facing cup portion and the rearward facing cup portion.

7. The shotgun cartridge of claim 1 wherein the interface extends substantially planarly and normal to an axis of the cartridge.

8. A shotgun cartridge for dispensing a shot load at a predetermined distance from a muzzle of a firearm, comprising:

a shotgun cartridge casing having a forward end and a rearward end closed by a case head;

a primer installed in the case head;

a propellant charge in the case head;

shot positioned at the forward end; and a shotgun wad comprising a nose portion and a tail portion and having a central axis;

the nose portion comprising a forward facing cup portion for receiving the shot load, the forward facing cup portion configured to engage a barrel of the firearm from which the cartridge is fired, wherein the nose portion entirely comprised of a first material;

a tail portion positioned against the propellant charge and defining a rearward facing cup portion for obturating and capturing propellant gases generated from the propellant charge when the cartridge is fired in the firearm, wherein the tail portion comprises a second material different from and less dense than the first material, the tail portion not extending to the forward end;

wherein one of the tail portion and nose portion are molded and the other of the tail portion and nose portion are overmolded on to the one of the tail portion and nose portion and thereby fixed to the one of the tail portion and nose portion and defining an interface portrayed as a line when the wad is viewed in cross section taken through the central axis, the interface extending entirely through the wad.

9. The shotgun wad of claim 8, wherein the first material is denser than the second material, and the nose portion and the tail portion are adapted to remain fixed to each other after being discharged from the muzzle of the firearm.

10. The shotgun cartridge of claim 8 wherein the first material of the wad comprises a first polymer and an additional material for weighting.

11. The shotgun cartridge of claim 8 wherein the nose portion of the wad further comprises metal.

12. The shotgun cartridge of claim 8 wherein the wad has a length and a center of gravity positioned along the length, and wherein the center of gravity is positioned at least 10% of the length forward of a location of where a center of gravity would be if the first material and second material were of the same density.

13. The shotgun cartridge of claim 8, wherein the nose portion and the tail portion each comprise a polymer common to both facilitating adhesion between the nose and tail portions.

14. A shotgun cartridge for dispensing a shot load at a predetermined distance from a muzzle of a firearm, comprising:

a shotgun cartridge casing having a forward end and a rearward end closed by a case head;

a primer installed in the case head;

a propellant in the case head; and a wad having a central axis and holding the propellant, the wad comprising a nose portion defining a forward facing cup portion and a tail portion defining a rearward facing cup portion, one of the nose portion and the tail portion being molded first, the nose portion and tail portion unitary by one of coinjection molding and overmolding, the one of coinjection molding and overmolding providing a nose portion-tail portion interface, the nose portion-tail portion interface extending entirely through the wad normal to the central axis;

wherein the nose portion is formed of a first polymer formulation and the second material is formed of a second polymer formulation different from and less dense than the first polymer formulation.

15. The shotgun cartridge of claim 14, wherein the first and second polymer formulations comprising a common polymer to promote adhesion between the first and second formulations at the nose-tail interface.

16. The shotgun cartridge of claim 14 wherein the nose portion further comprises metal.

17. The shotgun cartridge of claim 14 wherein the wad has a length and a center of gravity positioned along the length, and wherein the center of gravity is positioned at least 10% of the length forward of a location of where a center of gravity would be if the first material and second material were of the same density.

18. The shotgun cartridge of claim 14, wherein the first polymer formulations is denser than the second polymer formulation.

19. The shotgun cartridge of claim 14, further comprising shot positioned in the forward facing cup.

20. The shotgun cartridge of claim 14, wherein the tail portion defines a cup portion interfacing with the propellant.

* * * * *